United States Patent [19]

Merrien et al.

[11] Patent Number: 4,715,427

[45] **Date of Patent: * Dec. 29, 1987**

[54] PROCESS AND APPARATUS FOR AUTOMATING A BAKING CYCLE UNDER HOT AIR OF SAND MOLDS

[75] Inventors: Pierre L. Merrien, Billere; Pierre A. Merrien, Sceaux, both of France

[73] Assignee: Etude et Development en Metallurgie, Billere, France

[ * ] Notice: The portion of the term of this patent subsequent to Mar. 4, 2003 has been disclaimed.

[21] Appl. No.: 786,065

[22] Filed: Oct. 10, 1985

Related U.S. Application Data

[63] Continuation of Ser. No. 631,521, Jul. 18, 1984, Pat. No. 4,573,522, which is a continuation of Ser. No. 210,623, Nov. 26, 1980, abandoned.

[30] Foreign Application Priority Data

Nov. 28, 1979 [FR] France ..... 79 29227

[51] Int. Cl.[4] ..... B22C 9/12

[52] U.S. Cl. ..... 164/456; 164/12; 164/154

[58] Field of Search ..... 164/338.1, 456, 12, 164/150, 154

[56] References Cited

FOREIGN PATENT DOCUMENTS 2921403 11/1980 Fed. Rep. of Germany .
45-36110 11/1970 Japan .

*Primary Examiner*—Kuang Y. Lin
*Attorney, Agent, or Firm*—Sandler & Greenblum

[57] ABSTRACT

A process and apparatus for automating a hot-air baking cycle of sand molds. Such process and apparatus make it possible to regulate the hot-air baking or drying speed in a sand mold during a baking cycle. This regulation can be accomplished before casting, and in particular, before low-pressure casting. The process includes dividing the cycle into characteristic phases associated with particular baking parameters. The apparatus includes a calculator assembly for obtaining baking parameters. The invention can be used for the baking of foundry molds, and particularly, foundry molds for aeronautical parts.

27 Claims, 3 Drawing Figures

PROCESS AND APPARATUS FOR AUTOMATING A BAKING CYCLE UNDER HOT AIR OF SAND MOLDS

This is a continuation of application Ser. No. 631,521 filed July 18, 1984, now U.S. Pat. No. 4,573,522 which is a continuation of Ser. No. 210,623, filed Nov. 26, 1980, now abandoned.

TECHNICAL FIELD OF THE INVENTION

The present invention has for an object the regulation of hot air baking of foundry molds for diverse alloys, but particularly aluminum, adapted to be cast at low pressure.

BACKGROUND OF THE INVENTION

It is known that if one casts the molds made out of synthetic sand (silica, zircon for example connected by organic resins) without heating them first, one obtains elements with substantial risks of faults (blisters, micropores).

The heating of the core is generally carried out in an oven the heating of the molds is generally carried out and with a blowtorch. The mold is then assembled and closed before the casting.

However heating with the blowtorch is irregular and may not touch all of the surfaces, and in the interval of time necessary for the remolding before casting, the volatile products can return towards the impression.

In the low pressure casting of sand molds, the metal is injected from bottom to top through the lower surface of the mold. In gravity casting, on the other hand, the mold thus has an orifice on the other side of the mold. Furthermore, the mold, having no deadhead, is without an orifice at the upper portion.

SUMMARY OF THE INVENTION

It is thus possible to provide at the lower portion a hot air inlet according to FIG. I which makes possible:

(1) heating of the assembled mold, ready for casting;

(2) radial heating pushing the volatile products towards the exterior of the impression;

(3) possibility of casting immediately after the interruption of the drying.

Because these bakings are conducted empirically, the times, temperatures, and flow rates used are those which have in the past given good results. They must therefore be established statistically for each type of element. In one embodiment, the invention relates to an automation process for a hot air baking cycle of a sand mold. The process comprises the steps of dividing the baking cycle into a plurality of phases, determining optimal baking parameters associated with each of the phases by hot air baking of the sand mold during a development stage, recording the parameters associated with each of the phases, casting a sample in the mold, examining the surface of the sample for microporosities by means of fluorescent sweating, establishing correlations between the recorded parameters and microporosities which exist at the surface of the sample,. and regulating a hot air inlet to an oven used in the baking cycle in a manner so as to assure correspondence between the optimal parameters determined and those actually obtained during the performance of the baking cycle.

In another embodiment, the method of the present invention relates to an automation process for a hot air baking cycle for baking a mold, comprising a plurality of phases. The process comprises the steps of determining baking parameters associated with each of the phases by hot air baking of the mold, recording parameters associated with each of the phases, casting a sample in the mold, examining the surface of the sample for microporosities by means of fluorescent sweating, establishing correlations between the recorded parameters and microporosities at the surface of the casting sample, and regulating the hot air inlet to the mold used in the baking cycle in a manner so as to ensure correspondence between the parameters determined and those actually obtained during the performance of the baking cycle. In this embodiment, baking cycle comprises two phases. In the first phase, the volatile product concentration in the air at the upper portion of the mold is greater than or equal to that of an initial value. In the second phase, the volatile product concentration decreases slowly to maintain the mold until the casting of the casting element. In this embodiment, the regulating step is initiated in response to a signal from an analysis electrode for measuring the volatile product concentration.

In still another embodiment, the method of the present invention comprises an automated process for controlling hot air evaporation of volatile organic materials contained in the sand mold which is designed for low pressure casting. The process comprises the steps of separating the evaporation of the volatile organic materials into a plurality of phases, predetermining control parameters associated with the plurality of phases by recording the concentration of the organic materials evaporating from the sand mold over time, establishing correlations between the concentrations over time and microporosities on the surface of the casting sample which is cast in the mold, and regulating the hot air entering the mold in an actual production cycle so that the actual parameters obtained in the course of an actual production cycle conform to the control parameters, whereby the evaporation of the volatile organic materials is carried out under pre-set conditions.

In this embodiment, the predetermining step further comprises pre-determining control parameters comprising the velocity of the decrease in the concentration of the volatile organic materials evaporating from the sand mold as a function of time. The regulating step further comprises regulating the velocity of the decrease in the concentration of the volatile organic materials evaporating from the sand mold in an actual production cycle to ensure conformity between the predetermined velocity and the actual velocity of decrease in the concentration of the volatile organic materials evaporating from the sand mold during of actual production cycle. In addition, the process further comprises determining the microporosities on the surface of the casting sample by the process of fluorescent sweating.

In this embodiment, the separating step comprises the steps of separating the evaporation into first and second phases. The first phase comprises a beginning and an end. In the first phase, the concentration of volatile organic materials in the air that evaporates from the mold after the beginning is at a value higher than the volatile organic material concentration at the beginning of the first phase. In the second phase, the concentration of the volatile organic materials decreases below the value at the beginning of the first phase. In this embodiment, the regulating step begins at the beginning of the second phase in response to a signal from a means for determining the concentration of volatile organic materials in the air evaporating from the mold.

The predetermined step in this embodiment further comprises: heating the mold to vary the decrease in the velocity of evaporation of the volatile organic materials to produce an evaporation curve of the concentration of volatile organic materials over time; examining the external conditions of the casting sample; repeating these two previous steps a plurality of times to produce a plurality of curves; and establishing statistical correlations between the plurality of curves and the results of the examination of the external condition of the mold so as to determine an optimum evaporation curve for the mold, whereby the process uses the minimum amount of time and the minimum amount of energy in heating the mold to obtain a satisfactory casting.

In addition, the regulating step further comprises the steps of: measuring the actual change in the volatile organic materials concentration $\Delta C_R$ over a particular period of time $\Delta T$ and calculating the theoretical organic material concentration $\Delta C_T$ over the period of time $\Delta T$, based on the optimal evaporation curve by the formula $\Delta C_T = V_3 \Delta T$; comparing $\Delta C_R$ and $\Delta C_T$; and passing hot air into the mold if $\Delta C_R$ is less than or equal to $\Delta C_T$, and stopping the passing of hot air into the mold if $\Delta C_R$ is greater than $\Delta C_T$. In this embodiment, the hot air that is cast into the mold has a temperature of approximately 150°.

In still another embodiment the invention relates to a method of ensuring the proper removal of a volatile organic material from an object. The method comprises the steps of determining an optimal concentration removal rate of a volatile organic material to be evaporated from an object as a function of time, and heating the object in such a manner that the concentration of volatile organic material evaporating from the object as a function of time substantially conforms to the optimal concentration removal rate. The determining step discussed above comprises:

(i) measuring the concentration of volatile organic materials evaporating from an object as a function of time;
(ii) recording the concentration of volatile organic materials evaporating from the object as a function of time;
(iii) casting a sample in the test object and examining the condition of the cast element; and
(iv) establishing a correlation between the results of the examination and the concentration of volatile materials evaporating from the object as a function of time. The determining step further comprises:
(v) varying the concentration of volatile organic material evaporating from the object as a function of time;
(vi) repeating steps (i), (ii), (iii), (iv), and (v) a plurality of times to produce a plurality of results and a plurality of evaporation curves representing a plurality of volatile organic concentration material removal rates as a function of time; and
(vii) establishing correlation between the plurality of curves and a plurality of results to obtain the optimal concentration removal rate for producing an optimal result.

In addition, the heating step of this method comprises the step of blowing hot air into the contact with the object. In addition, in this embodiment the method further comprises a method of ensuring the proper removal of the volatile organic materials from a plurality of objects. In this embodiment the blowing step comprises blowing hot air into contact with the plurality of objects in such a manner that concentration of volatile organic materials evaporating from the object as a function of time is substantially the same as the optimal concentration removal rate. In addition, the blowing step further comprise in this embodiment the step of blowing hot air into contact with the plurality of objects from a single source of hot air.

In addition, in this embodiment, the blowing step further comprises the steps of: measuring the concentration of volatile organic materials evaporating from each of the objects; regulating the blowing of hot air into contact with a plurality of objects with a plurality of hot air inlet tubes, each connected to a single source of hot air and a plurality of automatic valves, each of the valves being positioned in a different one of the hot air inlet tubes, and one of the hot air inlet tubes being associated with each of the objects; and regulating the opening and closing of the plurality of automatic valves in such a manner that the concentration of volatile organic materials evaporating from the plurality of objects as a function of time substantially conforms to the optimal concentration removal rate.

The invention also relates to an apparatus for ensuring the proper removal of volatile organic materials from an object. The apparatus comprises: means for determining an optimal concentration removal rate of volatile organic materials evaporating from an object as a function of time; and means for heating the object in such a manner that the concentration of volatile organic materials evaporating from the object as a function of time substantially conforms to the optimal concentration removal rate. In addition, the heating means comprises blowing means for blowing hot air into contact with the object.

The determining means comprises:

(i) means for measuring the concentration of volatile organic materials evaporating from the object as a function of time;
(ii) means for recording the concentration of volatile organic materials evaporating from the object as a function of time;
(iii) means for casting an element in the object;
(iv) means for ascertaining whether the cast element is satisfactory;
(v) means for varying the concentration of volatile organic materials evaporating from the object as a function of time; and
(vi) means for repeating steps (i), (ii), (iii), and (iv) as a plurality of times to produce a plurality of results and a plurality of evaporation curves representing a plurality of volatile organic material concentrations as a function of time, whereby the optimal concentration removal rate can be determined by establishing correlations between a plurality of evaporation curves and a plurality of results.

The measuring means comprises means for measuring the actual change in the concentration of volatile organic material $\Delta C_R$ evaporating from the object over a particular period of time $\Delta T$. The apparatus further comprises means for calculating the change in the optimal concentration of volatile organic material $\Delta C_T$ evaporating from the object over a period of time $\Delta T$, by the formula $\Delta C_T = V_3 \Delta T$, where $V_3$ comprises the velocity of the decrease in the optimal concentration removal rate. In addition, the comparing means comprises means for comparing $\Delta C_R$ with $\Delta C_T$.

The adjustment means comprises means for blowing hot air into contact with the object if $\Delta C_R$ is less than $\Delta C_T$ and a means for preventing the blowing of hot air into contact with the object if $\Delta C_R$ is greater than $\Delta C_T$.

The adjusting means further comprises means for blowing hot air into contact with the object when $\Delta C_R$ is equal to $\Delta C_T$.

DETAILED DESCRIPTION OF THE INVENTION

It is an object of the present invention for the hot air baking to be regulated to minimize heating time and intensity, making it possible to assure satisfactory conditions before low pressure molding.

The method consists of a process and an apparatus for its application.

The process includes dividing of the baking operation into various phases and determining baking parameters for each phase.

Figure 2:
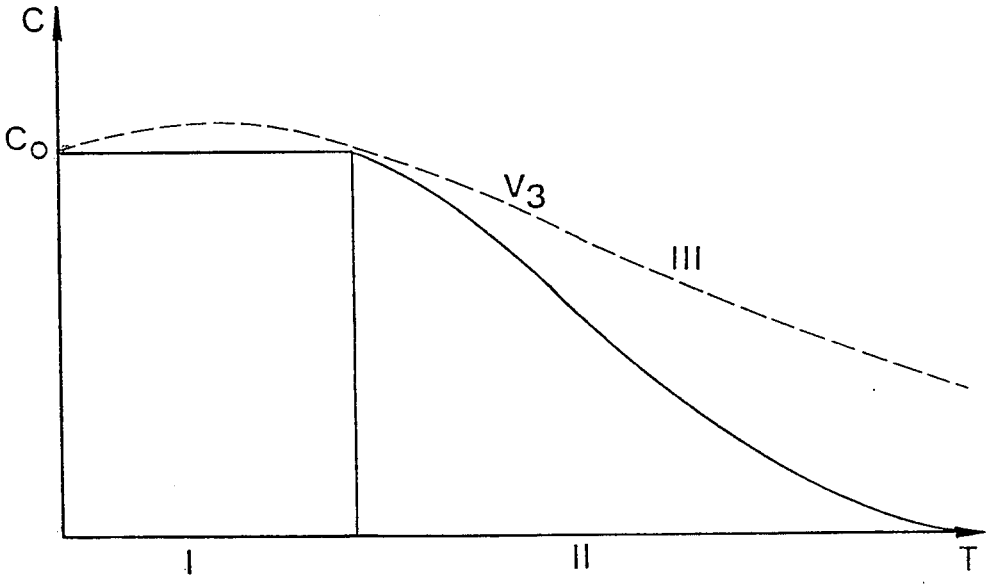
FIG. 2 is a graphical representation of an evaporation curve for volatile organic materials.
Figure 3:
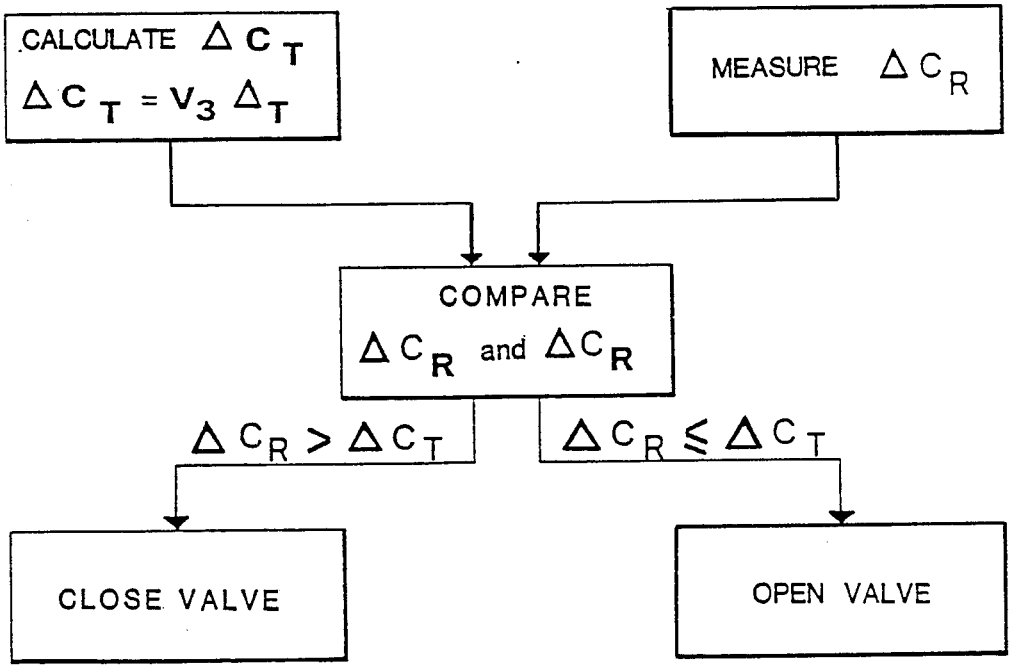
FIG. 3 is a block diagram of a pilot of the apparatus according to the present invention.

Hot air baking of sand molds under low pressure comprises two essential phases represented in FIG. 2.

Figure 1:
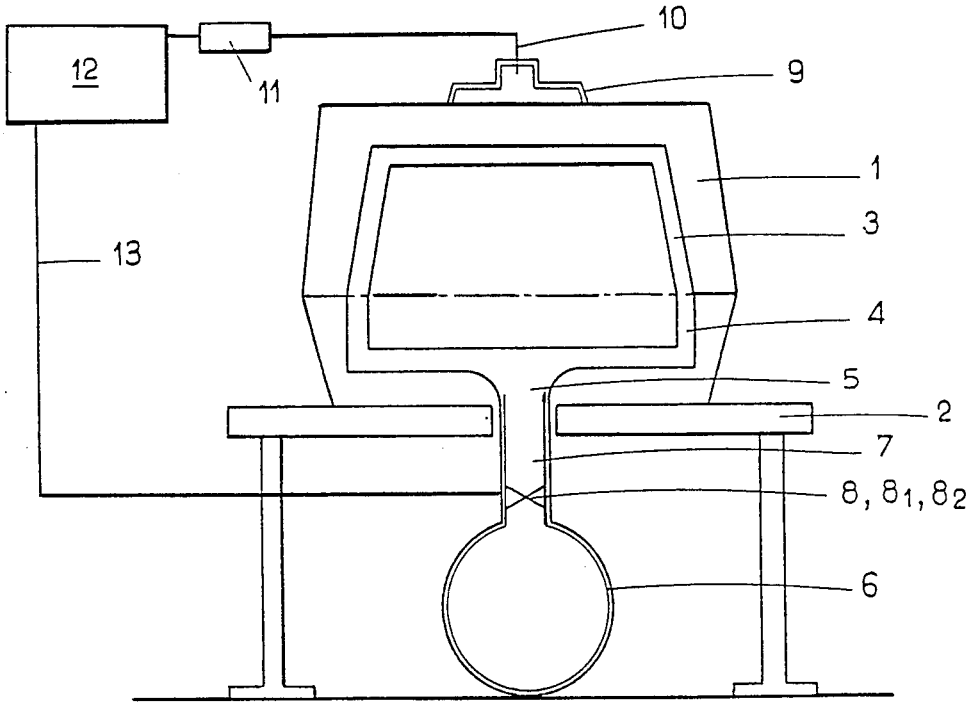
FIG. 1 illustrates a device for the hot-air baking of foundry molds for various alloys.

The curve in FIG. 2, as a function of time, the organic volatile materials concentration in the air leaving the upper surface of mold A in FIG. 1.

During Phase I the concentration of volatile materials remains substantially constant, or rises and then returns to its original value.

During Phase II the concentration decreases from this original value to the value 0.

In the present invention one replaces phase II which describes the typical decrease in the concentration of volatile organic materials evaporating from the mold with a phase III in which the concentration of volatile organic materials evaporating from the mold decreases more slowly than in phase II.

This slow speed of decrease of concentration during Phase III assumes appropriate maintenance of the sample before casting by introducing data in a pilot to control an automated valve which controls the inlet of air into the mold.

The embodiment according to FIG. 1 includes:

(1) a sand mold (1);
(2) placed on a plate (2);
(3) with its impression (3);
(4) its casting system (4);
(5) its inlet cone (5);
(6) a hot air line (6);
(7) an air inlet tube into the mold (7);
(8) an automated valve (8);
(9) a measurement device with a hood (9);
(10) an analysis electrode (10);
(11) a concentration recorder (11);
(12) an automation pilot (12); and
(13) a control circuit (13) for controlling valve (8) which is automated by pilot (12).

Pilot 12 comprises:

(1) an inlet-outlet assembly;
(2) a calculator assembly; and
(3) a memory assembly, and can be constituted around microprocessors and electronic clocks.

The parameters of the base curve of FIG. 2 are introduced in the inlet-outlet assembly, i.e.,:

(1) the speed $V_3$ of diminution of volatile materials concentration
(2) the interval of time measured $\Delta T$; and
(3) the volatile materials concentration which at the start $C_O$, is taken as O in the system.

The calculator assembly performs the following functions:

(1) receives the indication of variation of real concentration variation in time $\Delta T$ which is represented by $\Delta C_R$.
(2) calculates the theoretical concentration variation to be provided for the same interval $\Delta T$ by the formula:

$$\Delta C_T = V_3 \Delta T$$

(3) compares $\Delta C_R$ and $\Delta C_T$;
(4) controls
(a) the closing of the automated valve if $\Delta C_R > \Delta C_T$;
(b) the opening of the valve if $\Delta C_4 \leqq \Delta C_T$ The regulation assembly is shown by the schematic diagram of FIG. (3).

Pilot 12 can receive information from several driers and regulate them in the same automated valves $8_1 - 8_2 - 8_3$ etc. The outlets towards the molds are all shunted on central hot air line (6).

The memory assembly receives and stores various values for speeds $V_3$ suited for different types of elements.

The apparatus is used as follows. During one formation of the standard part, the drying curves and the registered drying curves is compared with the surface reactions of the uncovered element which take the form of microporosities with fluorescent sweating.

The temperature of the air can, for example, be the range of 150° C.

We claim:

1. A method of ensuring the proper removal of volatile organic materials from an object, said method comprising the steps of:

(a) determining an optimal concentration removal rate of volatile organic materials to be evaporated from an object as a function of time; and
(b) heating said object in such a manner that the concentration of volatile organic materials evaporating from said object as a function of time substantially conforms to said optimal concentration removal rate.

2. The method defined by claim 1 wherein said heating step comprises blowing hot air into contact with said object.

3. The method defined by claim 2 wherein said blowing step comprises blowing hot air into said object.

4. The method defined by claim 2 wherein said determining step comprises:

(i) measuring said concentration of volatile organic materials evaporating from an object as a function of time;
(ii) recording said concentration of volatile organic materials evaporating from said object as a function of time;
(iii) casting a sample in the object and examining the condition of the casted sample; and
(iv) establishing a correlation between the results of the examination and the concentration of volatile materials evaporating from the object as a function of time.

5. The method defined by claim 4 wherein said determining step further comprises:

(v) varying the concentration of volatile organic materials evaporating from said test object as a function of time; and (vi) repeating steps (i), (ii), (iii), (iv) and (v) a plurality of time to produce a plurality of castings from said test objects and a plurality of evaporation curves representing a plurality of volatile organic material removal rates from the test objects as a function of time; and (vii) establishing correlations between said plurality of curves and said plurality of results to obtain said optimal concentration removal rate for producing an optimal result.

6. The method defined by claim 2 wherein said heating step further comprises the steps of:

(i) measuring the concentration of volatile organic materials actually evaporating from said object as a function of time;

(ii) comparing the measured concentration of volatile organic materials evaporating from said object as a function of time with said optimal concentration removal rate; and (iii) adjusting the flow of said blowing hot air blown into contact with said object so that said measured concentration of volatile organic materials evaporating from said object as a function of time substantially conforms to said optimal concentration removal rate.

7. The method defined by claim 6 wherein said measuring step comprises:

measuring the actual change in concentration of volatile organic materials $\Delta C_R$ evaporating from said object over a particular period of time $\Delta T$;

wherein said method further comprises the step of calculating the change in said optimal concentration removal rate $\Delta C_T$ evaporating from said object over said period of time $\Delta T$, by the formula $\Delta C_T = V_3\ 66\ T$, wherein $V_3$ comprises the velocity of decrease in said optimal concentration removal rate as a function of time; and wherein said comparing step comprises comparing $\Delta C_R$ and $\Delta C_T$.

8. The method defined by claim 7 wherein said adjusting step comprises the steps of increasing hot air flow if $\Delta C_4 < \Delta C_T$, and reducing the hot air flow if $\Delta C_R > \Delta C_T$.

9. The method defined by claim 8 wherein said adjusting step further comprises maintaining said hot air flow when said $\Delta C_R$ is equal to $\Delta C_T$.

10. The method defined by claim 2 wherein said blowing step comprises blowing hot air having a temperature of approximately 150° C.

11. The method defined by claim 2 wherein said blowing step further comprises the step of regulating the opening and closing of an automated valve in a hot air line for feeding hot air to said object, wherein said method further comprises the steps of:

storing said optimal concentration removal rate as a function of time in a memory;

calculating the optimal volatile organic material concentration in an interval of time $\Delta T$ by the relation $\Delta C_T = V_3\ \Delta T$, *wherein* $V_3$ comprises the velocity of decrease in said optimal concentration removal rate as a function of time;

measuring by means of a measurement electrode the concentration of volatile organic materials $\Delta C_R$ actually evaporating from said object over said time period $\Delta T$;

comparing $\Delta C_R$ and $\Delta C_T$; and sending a signal to said automated valve to close said automated valve if $\Delta C_R > \Delta C_T$, and sending a signal to said automated valve to open said valve if $\Delta C_R < \Delta C_T$.

12. The method defined by claim 11 wherein said method further comprises the step of:

sending a signal to said automated valve to open said valve when $\Delta C_R$ is equal to $\Delta C_T$.

13. The method defined by claim 2 wherein said method further comprises a method of ensuring the proper removal of volatile organic materials from a plurality of objects, wherein said blowing step comprises blowing hot air into contact with said plurality of objects in such a manner that the concentration of volatile organic materials evaporating from said objects as a function of time is substantially the same as said optimal concentration removal rate.

14. The method defined by claim 13 wherein said blowing step further comprises the step of blowing hot air into contact with said plurality of objects from a single source of hot air.

15. The method defined by claim 14 wherein said blowing step further comprises to steps of:

measuring the concentration of volatile organic materials evaporating from each of said objects;

regulating the blowing of hot air into contact with said plurality of objects with a plurality of hot air inlet tubes, each connected to said single source of hot air, and a plurality of automatic valves, each of said valves being positioned in a different one of said hot air inlet tubes, and one of said hot air inlet tubes being associated with each of said objects; and regulating the opening and closing of said plurality of automatic valves in such a manner that the concentration of volatile organic materials evaporating from said plurality of objects as a function of time substantially conforms to said optimal concentration removal rate.

16. An apparatus for ensuring the proper removal of volatile organic materials from an object, said apparatus comprising:

(a) means for determining an optimal concentration removal rate of volatile organic materials evaporating from an object as a function of time; and (b) means for heating said object in such a manner that the concentration of volatile organic materials evaporating from said object as a function of time substantially conforms to said optimal concentration removal rate.

17. The apparatus defined by claim 16 wherein said heating means comprises blowing means for blowing hot air into contact with said object.

18. The apparatus defined by claim 17 wherein said blowing means comprises means for blowing hot air into said object, whereby volatile organic materials are forced outside of said object.

19. The apparatus defined by claim 17 wherein said determining means comprises:

(i) means for measuring the concentration of volatile organic materials evaporating from an object as a function of time;

(ii) means for recording said object as a function of time;

(iii) means for casting a sample in the object and examining the condition of the casted sample; and (iv) means for ascertaining whether said condition is satisfactory.

20. The apparatus defined by claim 19 wherein said determining means further comprises:

(v) means for varying the concentration of volatile organic materials evaporating from said object as a function of time; and (vi) means for repeating steps (i), (ii), (iii), and (iv) a plurality of times to produce a plurality of results and a plurality of evaporation curves representing a plurality of volatile organic material concentrations as a function of time, whereby said optimal concentration removal rate can be determined by establishing correlations between said plurality of evaporation curves and said plurality of condition of said cast element samples.

21. The apparatus defined by claim 17 wherein said apparatus further comprises:

(i) means for measuring the concentration of volatile organic materials evaporating from said object as a function of time;

(ii) means for comparing the concentration of volatile organic materials evaporating from said object as a function of time with said optimal concentration removal rate; and (iii) means for adjusting the flow of said hot air blown so that the measured concentration of volatile organic materials evaporating from said object as a function of time substantially conforms to said optimal concentration removal rate.

22. The apparatus defined by claim 21 wherein said measuring means comprises:

means for measuring the actual change in concentration of volatile organic materials $\Delta C_R$ evaporating from said object over a particular period of time $\Delta T$; and wherein said apparatus further comprises means for calculating the change in the optimal concentration of volatile organic material $\Delta C_T$ evaporating from said object over said period of time $\Delta T$, by the formula $\Delta C_T = V_3 \Delta T$, wherein $V_3$ comprises the velocity of decrease in said optimal concentration removal rate; and wherein said comparing means comprises means for comparing $\Delta C_R$ and $\Delta C_T$.

23. The apparatus defined by claim 22 wherein said adjusting means comprises means for blowing hot air into contact with said object mold if $\Delta C_R < \Delta C_T$, and means for preventing the blowing of hot air into contact with said object if $\Delta C_R > \Delta C_T$.

24. The apparatus defined by claim 23 wherein said adjusting means further comprises means for maintaining the blowing of hot air into contact with said object with $\Delta C_R$ is equal to $\Delta C_T$.

25. The apparatus defined by claim 17 wherein said blowing means comprises means for producing hot air having a temperature of approximately 150° C.

26. The apparatus defined by claim 17 wherein said apparatus further comprises a measurement electrode for measuring the concentration of volatile organic materials actually evaporating from said object as a function of time, wherein said blowing means further comprises:

a hot air feed line for feeding hot air to said object; and an automated valve in said hot air feed line;

wherein said apparatus further comprises means for regulating the opening and closing of said automated valve in said hot air line, wherein said regulating means comprises:

(aa) means for storing said optimal concentration removal rate;

(bb) means for calculating the optimal concentration removal rate in an interval of time $\Delta T$ by the relation $\Delta C_T = V_3 \Delta T$, wherein $V_3$ comprises the velocity of decrease in said optimal concentration removal rate;

(cc) means for measuring the concentration of volatile organic materials $\Delta C_R$ actually evaporating from said object over said time period $\Delta T$;

(dd) means for comparing $\Delta C_R$ and $\Delta C_T$; and (ee) means for sending a signal to said automated valve to close said automated valve is $\Delta C_R > \Delta C_T$, and means for sending a signal to said automated valve to open said valve if $\Delta C_R < \Delta C_T$.

27. The apparatus defined by claim 26 further comprising means for maintaining said automated valve in said open position when $\Delta C_R$ is equal to $\Delta C_T$, and means for opening said automated valve when $\Delta C_R$ changes from being greater than $\Delta C_T$ to being equal to $\Delta C_T$.

* * * * *

UNITED STATES PATENT AND TRADEMARK OFFICE

CERTIFICATE OF CORRECTION

PATENT NO. : 4,715,427

DATED : December 29, 1987

INVENTOR(S) : Pierre L. MERRIEN et al.

It is certified that error appears in the above-identified patent and that said Letters Patent is hereby corrected as shown below:

Column 1, line 24, insert ---and--- after "oven".

Column 1, line 25, delete "and" (first occurrence).

Column 5, line 46, change "assumes" to ---assures---.

Column 6, line 23, change "$C_4$" to ---$C_R$---.

Column 7, line 42, delete "66"; and line 49, change "$C_4$" to ---$C_R$---.

Column 10, line 40, change "is" to ---if---.

Signed and Sealed this

Fifteenth Day of November, 1988

*Attest:*

DONALD J. QUIGG

*Attesting Officer*

*Commissioner of Patents and Trademarks*